US007293319B2

(12) United States Patent
Charbeneau

(10) Patent No.: US 7,293,319 B2
(45) Date of Patent: Nov. 13, 2007

(54) PAINT ROLLER FRAME

(76) Inventor: Leonard Lee Charbeneau, P.O. Box 877, Belton, TX (US) 76513

( * ) Notice: Subject to any disclaimer, the term of this patent is extended or adjusted under 35 U.S.C. 154(b) by 0 days.

(21) Appl. No.: 11/510,127

(22) Filed: Aug. 25, 2006

(65) Prior Publication Data

US 2007/0050935 A1 Mar. 8, 2007

Related U.S. Application Data

(63) Continuation-in-part of application No. 10/896,796, filed on Jul. 21, 2004, now Pat. No. 7,216,394, which is a continuation-in-part of application No. 10/116,153, filed on Apr. 4, 2002, now abandoned.

(60) Provisional application No. 60/283,427, filed on Apr. 11, 2001.

(51) Int. Cl.
*B05C 17/02* (2006.01)

(52) U.S. Cl. ..... 15/230.11; 492/13; 492/19

(58) Field of Classification Search ..... 15/230.11; 492/13, 19

See application file for complete search history.

(56) References Cited

U.S. PATENT DOCUMENTS 4,089,082 A * 5/1978 McGrew ..... 15/230.11
4,528,714 A * 7/1985 Beck ..... 15/230.11
5,261,142 A * 11/1993 Linn et al. ..... 15/145
5,497,527 A * 3/1996 Jang et al. ..... 15/230.11

* cited by examiner

*Primary Examiner*—Mark Spisich
(74) *Attorney, Agent, or Firm*—Buchanan Ingersoll & Rooney LLP

(57) ABSTRACT

An improved paint roller frame made from a single length of rod having a first 90 degree bend delimiting a first segment formed at one end thereof and adapted to form an axle about which a paint roller can be rotatably mounted, and second and third bends delimiting second and third segments both of which lie in a plane in common with the first segment. The remaining portion of the rod is further deformed at a mid-portion thereof to include a fourth bend in which the rod is wound through 391 degrees about an imaginary axis extending parallel to the first segment and delimiting a fourth segment lying in the common plane and a fifth segment lying in a plane intersecting the common plane at an angle of 31 degrees, the fifth segment being adapted to be affixed to an elongated handle member. When combined with a paint roller and handle, a novel paint roller assembly is provided in accordance with the present invention. An alternative embodiment includes a pair of mirror image arms of the type described above, the distal ends of which are adapted to rotatably engage opposite ends of a roller.

3 Claims, 4 Drawing Sheets

PAINT ROLLER FRAME

RELATED APPLICATIONS

This application is a continuation-in-part of application Ser. No. 10/896,796 filed Jul. 21, 2004, now U.S. Pat. No. 7,216,394, which is a continuation-in-part of application Ser. No. 10/116,153 filed Apr. 4, 2002, now abandoned. Priority is also claimed to Provisional Application 60/283,427 filed Apr. 11, 2001, the disclosures of each being expressly incorporated herein by reference.

FIELD OF THE INVENTION

This application relates generally to paint roller apparatus, and more specifically to an improved paint roller carrying frame and apparatus having means formed in the handle shaft thereof for displacing the carried roller out of the plane of the handle and for resiliently absorbing the shock forces normally transmitted into the handle as the apparatus is being used.

BACKGROUND OF THE INVENTION

Heretofore, various types of paint roller supporting frames have been provided in applicator assemblies for enabling paints and other fluid coating materials to be applied to a wide variety of surfaces. A typical applicator includes a frame with a handle for the user to grasp the applicator and a rotatable absorbent covering, or roller, mounted on the end of the frame opposite the handle to permit the user to roll paint onto a surface. The frame and roller handle are sufficiently rigid so that a user can apply sufficient pressure to the roller via the handle and frame to roll the paint onto a surface. When a user needs a longer handle in order to paint overhead surfaces, the conventional way to extend the length of the roller carrying frame is to insert a second longer handle into a threaded socket provided in the butt end of the roller handle. In many situations it is desirable that the roller per se be turned at an angle relative to the handle so that the user is able to place and then roll the roller as required to apply the paint to the intended surface.

Applicant has identified at least three related problems associated with the prior art that seriously detract from the usefulness or effectiveness of the available roller painting apparatus. One of the problems relates to the positioning of the axis of rotation of the roller in the same plane as the handle, so as to require an unfavorable wrist extension when using the apparatus. Another problem is that means are not provided in the prior art for absorbing the vibratory energy generated and transmitted back to the handle as the roller rolls over the surface being coated. As a consequence the roller tends to skip rather than glide as it moves across the surface to be painted, and the hands and arms of the user become fatigued. A third problem is the torque or twisting action that is communicated to the painters hands due to the fact that the roller is supported from one end and forces applied thereto by the engaged surface being painted require that the painter apply a countering twist to the handle. These three factors contribute substantially to the tiring of the user and the inefficiency of use of the common roller applicator Numerous configurations of handle and frame have been provided to accommodate the need for positional adjustment of the roller relative to the handle. For example, McGrew U.S. Pat. No. 4,089,082 discloses an adjustable paint roller having in addition to a knuckle joint which pivots the roller support bar on the connector shank, a supplemental elbow brace connecting the shank and the roller support bar to provide additional strength. The elbow brace is comprised of two pivotal legs one of which abuts against the shank of the assembly when the roller is in its position of maximum adjustment, thus limiting this position to an 80 degree adjustment from the normal orientation of the roller. The other leg of the elbow brace will abut the roller support assembly when the elbow joint is thrust forwardly so that a 45 degree angle is automatically established in this mode. Note however, that at all positions of adjustment the roller lies in the same plane as the handle.

An adjustable roller similar to that of McGrew is disclosed by Beck U.S. Pat. No. 4,528,714 which incorporates a bolt and wingnut assembly into his frame structure to permit positional change of the roller relative to the frame and handle. But here again the roller and handle remain in the same plane.

Another attempt to address the problems sought to be solved by the present invention is provided by Jang et al who improve on the Beck concept by providing a paint roller frame assembly having an adjustment capability that permits switching between two paint rolling directions or between two tilted painting angles. The frame comprises a roller cage assembly, a shaft for receiving the roller cage assembly, and a handle for supporting the shaft. The handle or its extension pole comprises two substantially elongated members that are releasably fastened with a fastening means. Each of the mating ends of the two handle members has an oblique end section to which the normal is inclined with respect to the longitudinal axis of the corresponding handle member at angle. Although this structure may address one of the objectives of the present invention in a different way, the bolt together fastening means to effect angulation between handle and roller clearly does not address the issue of absorption of shock forces transmitted from the roller into the handle.

SUMMARY OF THE INVENTION

It is therefore a principal objective of the present invention to provide an improved paint roller frame apparatus adapted to be anatomically more suited to the hand and arm of a user.

Another objective of the present invention is to provide an improved paint roller frame apparatus having the capability of absorbing shock forces created in the roller as it is rolled or a surface to be coated.

Still another objective of the present invention is to provide improved paint roller frame apparatus adapted to be anatomically more suited to the hand and arm of a user as well as having the capability of absorbing shock forces created in the roller as it is rolled over a surface to be coated so as to tend to reduce the fatigue experienced by a user when using apparatus of this type to apply a coating of fluid material to a surface.

Briefly, a presently preferred embodiment of the present invention provides an improved paint roller frame made from a single length of rod having a first 90 degree bend delimiting a first segment formed at one end thereof and adapted to form an axle about which a paint roller will be rotatably mounted, and second and third bends delimiting second and third segments both of which lie in a plane in common with the first segment. The remaining portion of the rod is further deformed at a mid-portion thereof to include a fourth bend in which the rod is wound through 391 degrees about an imaginary axis extending parallel to the first segment and delimiting a fourth segment lying in the common plane and a fifth segment lying in a plane intersecting the common plane at an angle of approximately 31 degrees, the fifth segment being adapted to be affixed to an elongated handle member. When combined with a paint roller and handle, a novel paint roller assembly is provided in accordance with the present invention.

In an alternative embodiment the single length of rod stock is extended to be twice as long and the second half is deformed in mirror image fashion to that described above so as to form a like segmented, corresponding frame portion for engaging the opposite end of a paint roller. By simply spreading the two frame portions a roller can be operatively engaged to rotatable coupling fittings affixed to the distal each arm of the assembly and be retained thereby when the spreading forces are released.

An advantage of the present invention is that it provides an improved paint roller frame apparatus which is anatomically better suited to the hand and arm of a user than are prior art roller apparatus in that it allows the user to position his wrist at a more relaxed angle than has heretofore been required.

Another advantage of the present invention is that it provides an improved paint roller frame apparatus having the capability of absorbing shock forces created in the roller as it is rolled or a surface to be coated and thereby isolates the user at least in part from such forces.

Still another advantage of the present invention is that it provides an improved paint roller frame apparatus adapted to be anatomically more suited to the hand and arm of a user as well as having the capability of absorbing shock forces created in the roller as it is rolled over a surface to be coated and thereby tends to reduce the fatigue experienced by a user when using apparatus of this type to apply a coating of fluid material to a surface.

A still further advantage of the present invention is that it provides an improved paint roller frame apparatus adapted to be anatomically more suited to the hand and arm of a user in that it imposes no rotational torque upon the users hands as it is rolled over a surface to be coated and thereby tends to reduce the fatigue experienced by a user when using apparatus of this type to apply a coating of fluid material to a surface.

These and other objects and advantages of the present invention will become apparent to those skilled in the art after having read the following detailed description of a preferred embodiment illustrated in the several figures of the drawing.

BRIEF DESCRIPTION OF THE DRAWING FIGURES

DETAILED DESCRIPTION OF THE PREFERRED EMBODIMENTS

The Concept of paint roller applicators is well known in the art. In general, a paint roller applicator includes a frame made up of a roller cage assembly, a shaft and a handle. The shaft is usually a properly bent metallic rod with one end connected to or integral with the roller cage, while the other end is connected to or partially embedded in a plastic or wood based handle.

The metallic rod is typically bent at two or three locations along its length so that it can be considered to consist of three or four segments each being a substantially straight member. The first segment is normally adapted to engage a cage or other means for mating with a roller of one type or another. The last segment is normally connected to an elongated generally cylindrical handle in such a fashion that the longitudinal axis of the handle lies in the plane of and extends substantially perpendicular to the roller cage axis.

Some paint roller frames are made from plastic and can break if excessive force or pressure is applied to them when applying paint materials. My preferred stock material is a solid metal rod made of ¼ inch aluminum or steel. However, rod stock of other materials and diameters can be used. For certain applications rigid plastic rod, plastic coated rod or tubular rod may also be suitable. Rod stocks of from 3⁄16" to 5⁄16" diameter are deemed suitable with ¼" aluminum or aluminum alloy being preferred.

Figure 1:
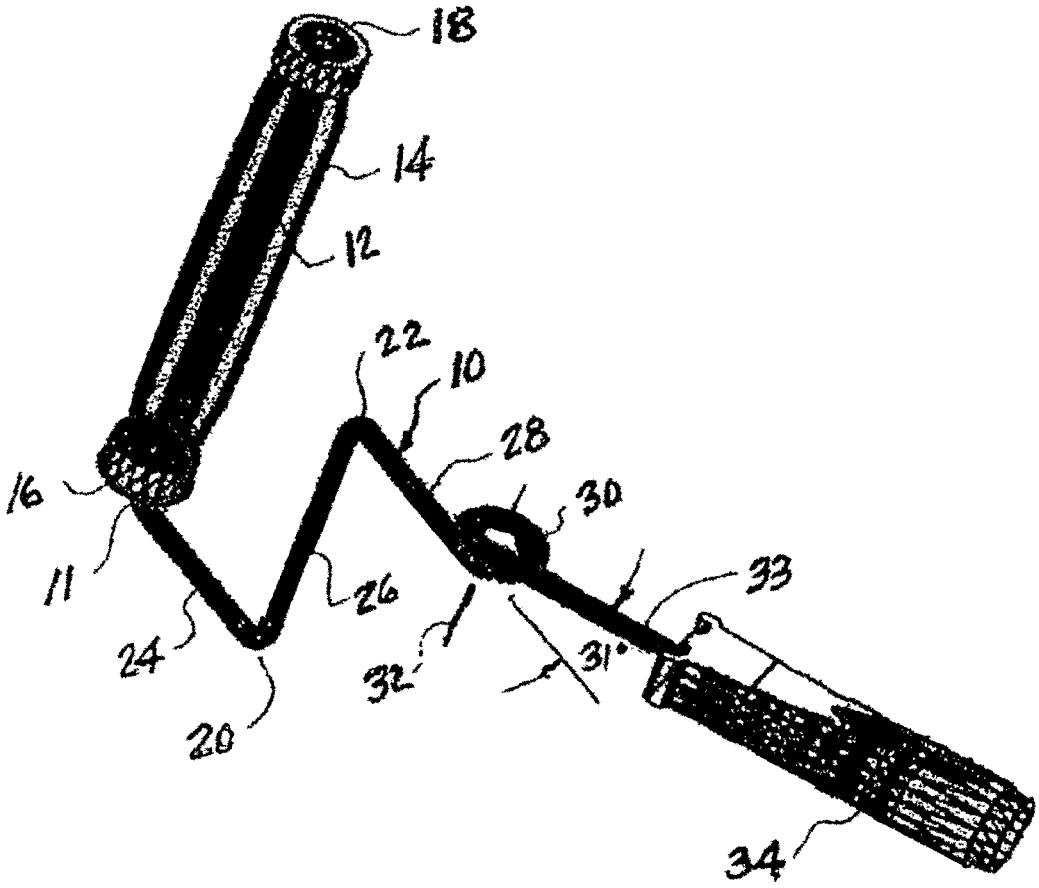
FIG. 1 is a perspective view of a paint roller frame in accordance with an embodiment of the present invention.

As depicted in FIG. 1 of the drawings, one embodiment of the present invention provides an improved paint roller frame made from one piece of solid metallic rod 10 and having an approximately 31 degree forward angle formed in the frame by virtue of a single 391 degree loop formed in the approximate center of the shaft portion extending out of the handle. However It has been found that loops of between 370 degrees and 405 degrees providing forward angles of between 10 degrees and 45 degrees are also suitable for some applications.

Figure 2:
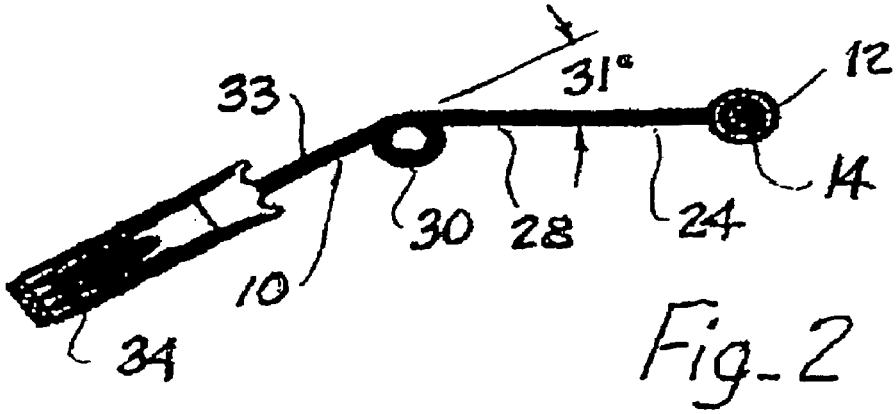
FIG. 2 is a right side elevational view of the embodiment of FIG. 1;.
Figure 3:
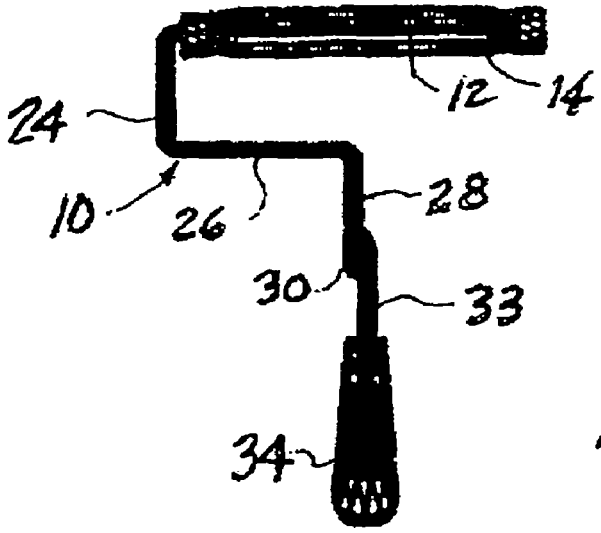
FIG. 3 is a top plan view elevation of the embodiment of FIG. 1.
Figure 4:
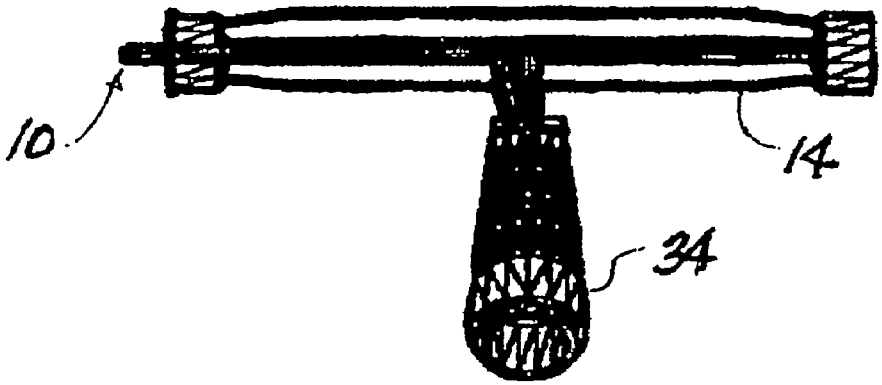
FIG. 4 is an elevational view from the handle end of the embodiment of FIG. 1.

More specifically, the rod 10 is deformed with a first 90 degree bend at 11 to form a first or distal segment 12 that serves as an axle shaft about which a roller cage 14 is journaled at its opposite ends 16 and 18. Rod 10 is similarly deformed by with 90 degree bends at points 20 and 22 to delimit second and third segments 24 and 26, both of which lie in a common plane with segment 12. The bend 22 also delimits one end of a fourth segment 28 that extends to a deformation at 30 wherein the rod is wound through 391 degrees about an axis 32 that extends parallel to segment 12 but is offset from the plane defined by segments 12, 24, 26 and 28. The bend 30 also defines one end of a proximal or fifth rod segment 33 that forms a shaft adapted to mate with a bore in a wooden or plastic handle 34. The net result of the several deforming bends is to provide a handle shaft segment 33 having a longitudinal axis that extends normal to a plane (different from the common plane mentioned above) including the roller shaft 12, but to cause the longitudinal axis to intersect the above mentioned common plane at an angle of approximately 31 degrees. This relationship is perhaps most apparent from the orthogonally related view of FIGS. 2 and 3.

No adjustments are required to use this paint roller frame, therefore there are no parts to break, misplace or get paint materials embedded in.

When applying paint or other materials to vertical surfaces with a standard straight shaft roller frame, much force is required at the users wrist to push the roller applicator to the surface to spread the coating. With this improved design roller frame, the fixed 31 degree forward angle allows the user to hold the handle at a more comfortable wrist angle and helps apply paint materials to the surface to be coated with less effort or force. When a user pushes this paint roller frame up a vertical surface to apply paint materials, the upward movement forces the paint roller frame to push forward into the surface to be painted. The single 391 degree loop and forward angle allow the frame to flex and absorb any vibration or bounce cased by the surface and thereby helps keep the roller applicator in contact with the surface to be coated.

When applying paint materials on horizontal overhead surfaces this improved design roller frame can be turned over with the 31 degree angle extending towards the surface being rolled. Alternatively, the 31 degree angle can be extended upwardly to facilitate passage of the roller under objects and obstructions with ease from an upright position when used with a pole extension attached to the handle.

This improved roller frame is also designed to be used to paint downward from overhead positions to apply coatings from structures such as bridge walkways or roadways over the wall or rails with an extension pole attached to the handle to apply a coating with less effort, more control and safety due to the forward 31 degree angle.

Figure 5:
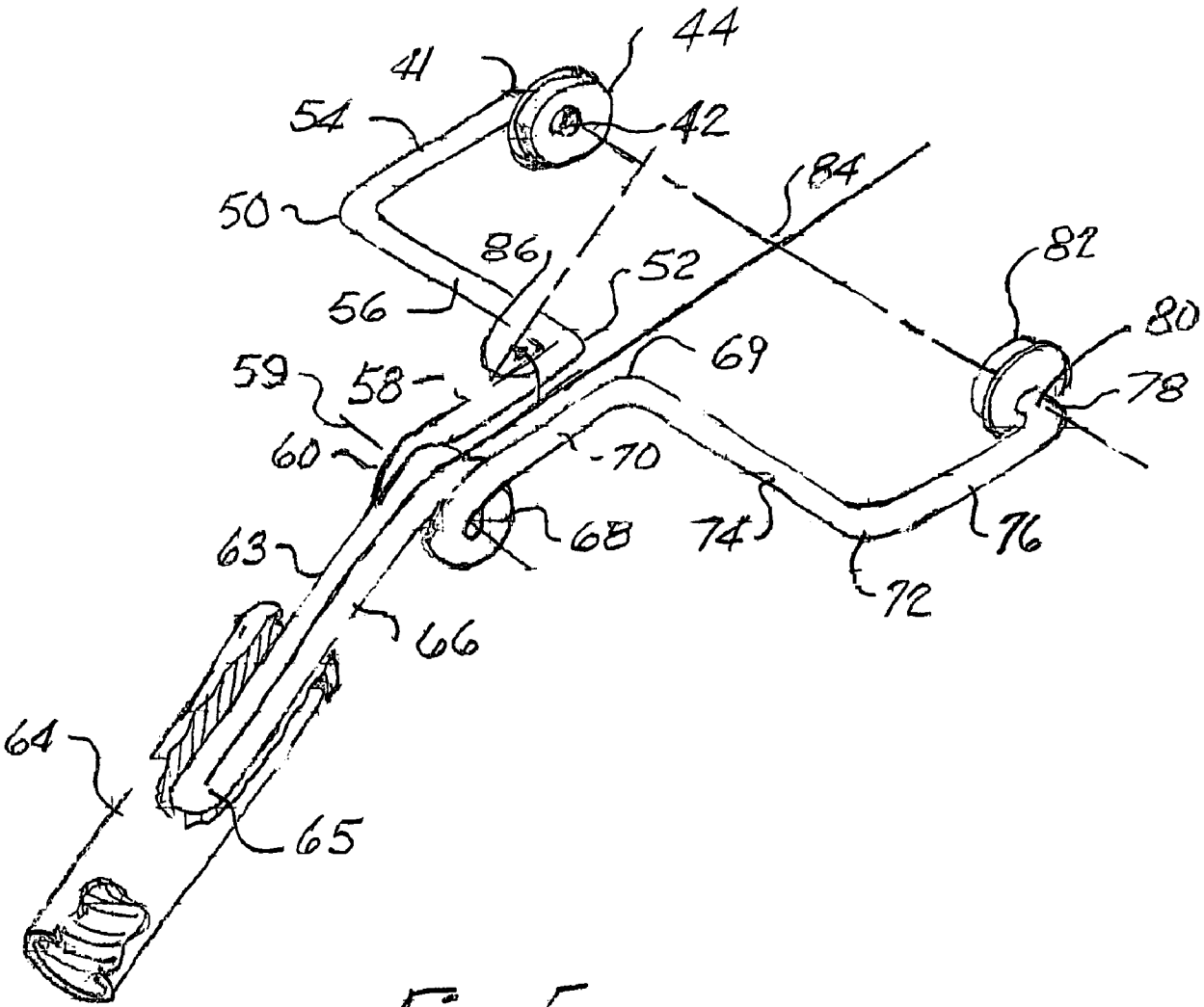
FIG. 5 is a perspective view of an alternative embodiment of a paint roller frame in accordance with the present invention.
Figure 6:
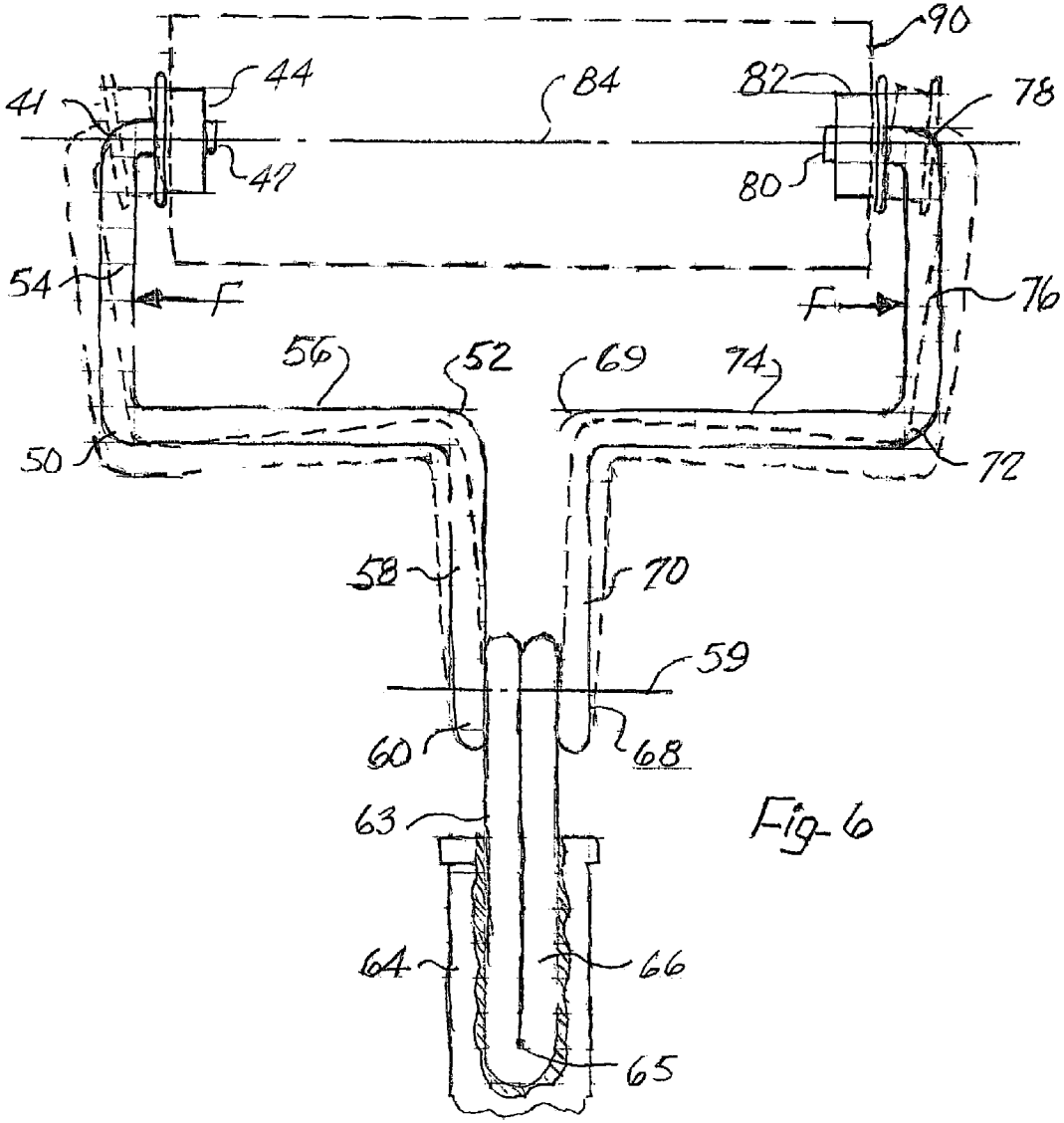
FIG. 6 is a top plan view elevation of the embodiment of FIG. 5.

Referring now to FIGS. 5 and 6, an alternative embodiment will be described in which the above described frame structure forms one of two frame arms that are integrally formed and adapted to engage the opposite ends of a roller. As depicted, this embodiment of the present invention also provides an improved paint roller frame made from one piece of solid metallic rod and in the preferred form also has an approximately 31 degree forward angle provided in the frame by virtue of 391 degree loops formed in the approximate center of a shaft portion extending out of a handle. However, in this embodiment, the starting length of rod stock is twice as long as the starting rod length of the first embodiment. The first half, or first arm, is deformed just as was done in the first embodiment, but the second half, or second arm, is deformed in mirror image fashion to that described above so as to form a like segmented, corresponding frame portion terminating in a second distal end for engaging the opposite end of a paint roller. No roller supporting cage is required in this embodiment because two spaced apart rotatable roller end fittings are provided on the distal ends of each arm of the frame. By simply spreading the two frame arms, a roller can be operatively engaged to the rotatable fittings affixed to the distal end of each arm and be retained thereby when the spreading forces are released.

As in the case of the first embodiment, loops of between 370 degrees and 405 degrees formed in each arm and providing forward angles of between 10 degrees and 45 degrees are also suitable for some applications.

More specifically, as was described above, the starting length of rod is deformed with a first 90 degree bend at 41 to form a first or distal segment 42 that serves as an axle shaft about which a first roller engaging hub 44 is journaled. The rod is similarly deformed by with 90 degree bends at points 50 and 52 to delimit second and third segments 54 and 56, both of which lie in a common plane with segment 42. The bend 52 also delimits one end of a fourth segment 58 that extends to a deformation at 60 wherein the rod is wound through 391 degrees about an axis 59 that extends parallel to segment 56 but is offset from the plane defined by segments 42, 54, 56 and 58. The winging bend 60 also defines one end of a proximal or fifth rod segment 63 that forms one half of a member adapted to mate with a bore in a wooden or plastic handle 64.

The rod is then bent 180 degrees at 65 so that a sixth rod segment 66 is formed lying parallel and adjacent to segment 63. The rod is then wound at 68 through 391 degrees about the axis 59 and continued forward in the plane common to segments 42, 54, 56 and 58 to a bend point 69 that determines the length of a seventh rod segment 70. The rod is then continued laterally in the common plane to a bend point 72 that determines the length of an eight segment 74.

At 72 the rod is again bent through 90 degrees to extend forward to form a ninth segment 76 also lying in the common plane. Finally, the rod is again bent back through 90 degrees at 78 and toward the opposing rod end 42 to form a tenth segment; the second distal end segment 80. Distal segment 80 serves as an axle shaft about which a second roller engaging hub 82 is journaled.

Similar to the first embodiment, the net result of the several deforming bends in this alternative embodiment is to provide a dual segmented handle shaft 63, 66 having longitudinal axes that extends normal to a plane (different from the common plane mentioned above) including a roller axis 84, but to cause the longitudinal axes to intersect the above mentioned common plane at an angle of approximately 31 degrees as suggested by the arrow 86.

In FIG. 6 the operation of installing a roller 90 is depicted. By applying spreading forces F to the side segments 54 and 76, the respective frame arms can be spread as suggested by the dashed lines thereby further separating the hubs 44 and 82 so as to allow the roller 90 to be positioned there between. Upon relaxation of the forces F, the arms will return to their parallel positions driving the hubs into the open ends of the roller. The device is now ready for use.

When applying paint or other materials to vertical surfaces with a standard straight shaft roller frame, much force is required at the users wrist to push the roller applicator to the surface to spread the coating. With either of the above described improved roller frame designs, the fixed 31 degree forward angle allows the user to hold the handle at a more comfortable wrist angle and helps apply paint materials to the surface to be coated with less effort or force. When a user pushes this paint roller frame up a vertical surface to apply paint materials, the upward movement forces the paint roller frame to push forward into the surface to be painted.

The single 391 degree loop and forward angle allow the frame to flex and absorb any vibration or bounce cased by the surface and thereby helps keep the roller applicator in contact with the surface to be coated. Furthermore, in use of the latter described embodiment, since balanced force is applied to each end of the roller no twist is imparted to the handle for communication to the hands of the user.

Although the present invention has been particularly shown and described above with reference to specific embodiments, it is anticipated that alterations and modifications thereof will no doubt become apparent to those skilled in the art. It is therefore intended that the following claims be interpreted as covering all such alterations and modifications as fall within the true spirit and scope of the invention.

What is claimed is:

1. A paint roller frame comprising:

a single length of rod having a first bend delimiting a first segment formed at one end thereof and adapted to form one end of an axle about which a paint roller can be rotatably mounted; said rod having second and third bends delimiting second and third segments both of which lie in a plane in common with said first segment; said rod being further deformed at a point along the length thereof to include a fourth bend in which the rod is wound through an angle of between 370 and 405 degrees about an imaginary axis extending parallel to said first segment and cooperating with said fourth bend to delimit a fourth segment lying in said common plane and a fifth segment lying in a plane intersecting said common plane at an angle of between 10 degrees and 45 degrees, said length of rod continuing beyond said fifth segment and being folded back 180 degrees to form a sixth segment lying parallel to and adjacent to said fifth segment, said rod then being wound about said imaginary axis and through an angle of between 370 and 405 degrees and continued forward in said common plane to form a seventh segment at the end of which said rod is bent and continued laterally in said common plane to form an eighth segment at the end of which said rod is again bent and extended forward in said common plane to form a ninth segment at the end of which said rod is again bent to form a tenth segment lying coaxial with said first segment and cooperating therewith to provide said axle about which a paint roller can be rotatably mounted; and an elongated handle affixed to said fifth and sixth segments.

2. A paint roller frame as recited in claim 1 and further comprising cylindrical hubs journaled to said first and tenth segments and adapted to respectively mate with the ends of a cylindrical opening passing through the roller.

3. A paint roller frame as recited in claim 1 wherein the longitudinal axes of said fifth segment and said sixth segment intersect said common plane at an angle of approximately 31 degrees and are normal to and intersects a plane including the axis of said axle.

* * * * *